US009859657B2

(12) United States Patent
Endo et al.

(10) Patent No.: US 9,859,657 B2
(45) Date of Patent: Jan. 2, 2018

(54) CONNECTOR APPARATUS WITH FIRST AND SECOND CONNECTORS AND INCLUDING TWO LATCHING MECHANISMS THAT ENABLE DETECTION OF AN UNENGAGED STATE

(71) Applicant: Dai-ichi Seiko Co., Ltd., Kyoto-shi, Kyoto (JP)

(72) Inventors: Takayoshi Endo, Shizuoka (JP); Takuya Takeda, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/367,731

(22) Filed: Dec. 2, 2016

(65) Prior Publication Data

US 2017/0170604 A1 Jun. 15, 2017

(30) Foreign Application Priority Data

Dec. 9, 2015 (JP) ..... 2015-240529

(51) Int. Cl.
*H01R 13/627* (2006.01)
*H01R 13/641* (2006.01)
(Continued)

(52) U.S. Cl.
CPC ..... *H01R 13/641* (2013.01); *H01R 12/707* (2013.01); *H01R 12/81* (2013.01);
(Continued)

(58) Field of Classification Search
CPC .. H01R 13/4538; H01R 13/6275; H01R 9/03; H01R 13/6272; H01R 13/641; H01R 13/7175
(Continued)

(56) References Cited

U.S. PATENT DOCUMENTS 4,431,244 A * 2/1984 Anhalt ..... H01R 13/6273 439/358
5,718,596 A * 2/1998 Inaba ..... H01R 13/639 439/352
(Continued)

FOREIGN PATENT DOCUMENTS

EP 0 840 398 A1 5/1998
JP 1996-180933 7/1996
(Continued)

OTHER PUBLICATIONS

European Search Report (Application No. 16202425.1); dated Feb. 6, 2017.
(Continued)

*Primary Examiner* — Thanh Tam Le
(74) *Attorney, Agent, or Firm* — Howard & Howard Attorneys PLLC

(57) ABSTRACT

A connector apparatus includes first and second connectors. The first connector includes a first latching part, a second latching part, and an arm supporting the second latching part, and visible from an exterior. The second connector includes a first latched part to be latched with the first latching part, and a second latched part to be latched with the second latching part. The second connector is to be engaged with the first connector. In accordance with an advancement of the engagement between the first connector and the second connector, as the first latched part is latched by the first latching part, the second latching part is guided by the second latched part and the arm is deflected, and after the latching between the first latching part and the first latched part, as the second latched part is latched by the second latching part, the deflection of the arm is canceled.

7 Claims, 21 Drawing Sheets

(51) Int. Cl.

| | |
|---|---|
| ***H01R 12/70*** | (2011.01) |
| ***H01R 12/81*** | (2011.01) |
| ***H01R 13/629*** | (2006.01) |
| ***H01R 24/20*** | (2011.01) |
| ***H01R 13/639*** | (2006.01) |
| *H01R 105/00* | (2006.01) |
| *H01R 12/71* | (2011.01) |

(52) U.S. Cl.
CPC ..... *H01R 13/629* (2013.01); *H01R 13/6272* (2013.01); *H01R 13/6273* (2013.01); *H01R 13/639* (2013.01); *H01R 24/20* (2013.01); *H01R 12/716* (2013.01); *H01R 2105/00* (2013.01)

(58) Field of Classification Search
USPC ..... 439/140, 345, 350–352, 489, 490
See application file for complete search history.

(56) References Cited

U.S. PATENT DOCUMENTS 6,024,594 A * 2/2000 Self, Jr. ..... H01R 13/6273 439/358
6,244,889 B1 * 6/2001 James ..... H01R 13/6275 439/258
6,461,187 B2 * 10/2002 Chen ..... H01R 13/6272 439/358
6,537,099 B2 * 3/2003 Herlinger ..... H01R 13/6397 439/352
6,824,417 B1 * 11/2004 Nimura ..... H01R 13/641 439/352
7,476,123 B2 * 1/2009 Kobayashi ..... H01R 13/4361 439/352
7,549,887 B1 * 6/2009 Ng ..... H01R 13/6272 439/352
7,614,904 B2 * 11/2009 Hiramatsu ..... H01R 13/639 439/352
7,682,181 B1 * 3/2010 Jones, Jr. ..... H01R 13/6272 439/352
8,043,106 B1 10/2011 Morello et al.
8,052,458 B2 * 11/2011 Rossman ..... H01R 13/6456 439/358
8,968,021 B1 * 3/2015 Kennedy ..... H01R 13/6273 439/352
2002/0031944 A1 3/2002 Endo
2010/0279536 A1 11/2010 Paulus

FOREIGN PATENT DOCUMENTS

JP 1997-306594 11/1997
JP 2005-116293 4/2005
JP 2011-210723 A 10/2011

OTHER PUBLICATIONS

Notification of Reasons for Refusal (JP Patent Application No. 2015-240529); dated Oct. 3, 2017; 8 pages.
Korean Office Action (KR Patent Application No. 10-2016-0165794); dated Oct. 19, 2017; 5 pages.

* cited by examiner

CONNECTOR APPARATUS WITH FIRST AND SECOND CONNECTORS AND INCLUDING TWO LATCHING MECHANISMS THAT ENABLE DETECTION OF AN UNENGAGED STATE

CROSS-REFERENCE TO RELATED APPLICATION

This application claims the benefit of Japanese Patent Application No. 2015-240529, filed on Dec. 9, 2015, the entire disclosure of which is incorporated by reference herein.

TECHNICAL FIELD

This application relates generally to a connector apparatus.

BACKGROUND ART

Unexamined Japanese Patent Application Kokai Publication No. 2011-210723 discloses a connector apparatus provided with a Connector Position Assurance (CPA) function. The connector apparatus disclosed in Unexamined Japanese Patent Application Kokai Publication No. 2011-210723 includes a first latching mechanism provided with a latching pawl and a latching shoulder, and a second latching mechanism employing the different structure from that of the first latching mechanism. Upon advancement of the engagement between a socket connector body and a plug connector body, the first latching mechanism becomes the latched condition, while at the same time, the second latching mechanism becomes the latched condition. The latched conditions of those two latching mechanisms cause the socket connector body and the plug connector body to be fully engaged with each other.

SUMMARY OF INVENTION

When the connector apparatus disclosed in Unexamined Japanese Patent Application Kokai Publication No. 2011-210723 is assembled, a case in which the one latching mechanism becomes the fully latched condition, while the other latching mechanism has not been fully latched yet may occur, and thus the engagement is not fully completed. The connector apparatus disclosed in Unexamined Japanese Patent Application Kokai Publication No. 2011-210723 does not allow an assembling user to easily detect such an incomplete engagement.

The present disclosure has been made in view of the foregoing circumstances, and an objective is to provide a connector apparatus capable of allowing a user to detect an incomplete engagement.

In order to accomplish the above objective, a connector apparatus according to an aspect of the present disclosure includes:

a first connector that includes a first latching part, a second latching part, and an arm supporting the second latching part, and visible from the exterior; and a second connector that includes a first latched part to be latched with the first latching part, and a second latched part to be latched with the second latching part, the second connector being to be engaged with the first connector, in which, in accordance with an advancement of an engagement between the first connector and the second connector, as the first latched part is latched by the first latching part, the second latching part is guided by the second latched part and the arm is deflected, and after the latching between the first latching part and the first latched part, as the second latched part is latched by the second latching part, the deflection of the arm is canceled.

The first latched part may include, from a leading-end side thereof in a fitting direction of the second connector into the first connector in sequence, a first inclined surface that guides the first latching part, and is inclined relative to the fitting direction, and a first parallel surface that is in parallel with the fitting direction, the second latched part may include, from the leading-end side thereof in the fitting direction in sequence, a second inclined surface that guides the second latching part, and is inclined relative to the fitting direction, and a second parallel surface that is in parallel with the fitting direction, and when the first latching part reaches the first parallel surface, the second latching part may also reach the second parallel surface.

The second latched part may include a standing-upright surface provided at a rear end of the second parallel surface in the fitting direction, and the standing-upright surface may include an inclined surface inclined relative to the fitting direction.

The arm may include a pair of bar members protruding from a body of the first connector, and the second latching part may be provided at each leading end of the bar members.

The pair of bar members may be formed so as to deflect in a direction spreading from each other after the first latched part is latched by the first latching part and until the second latched part is latched by the second latching part.

When the engagement between the first connector and the second connector completes, a position of a rear end of the second connector in the fitting direction, and a position of a leading end of the arm protruding from a body of the first connector may be on the same plane orthogonal to the fitting direction of the second connector.

The first connector may be a receptacle connector provided on a wiring board, and the second connector may be a plug connector that includes a terminal to which a wiring is connected.

The first and second connectors may each be a connector that includes a terminal to which a wiring is connected.

According to the present disclosure, when the engagement between the first connector and the second connector completes, the deflection of the arm that is visible from the exterior is canceled. An incomplete engagement between the first connector and the second connector is detectable upon checking the canceling of the deflection of the arm.

BRIEF DESCRIPTION OF DRAWINGS

A more complete understanding of this application can be obtained when the following detailed description is considered in conjunction with the following drawings, in which.

DESCRIPTION OF EMBODIMENTS

An explanation will be below given of a connector apparatus 10 according to an embodiment of the present disclosure with reference to FIGS. 1 to 20B. In order to facilitate understanding for the present disclosure, an XYZ coordinate system is set and is referred as appropriate.

Figure 1:
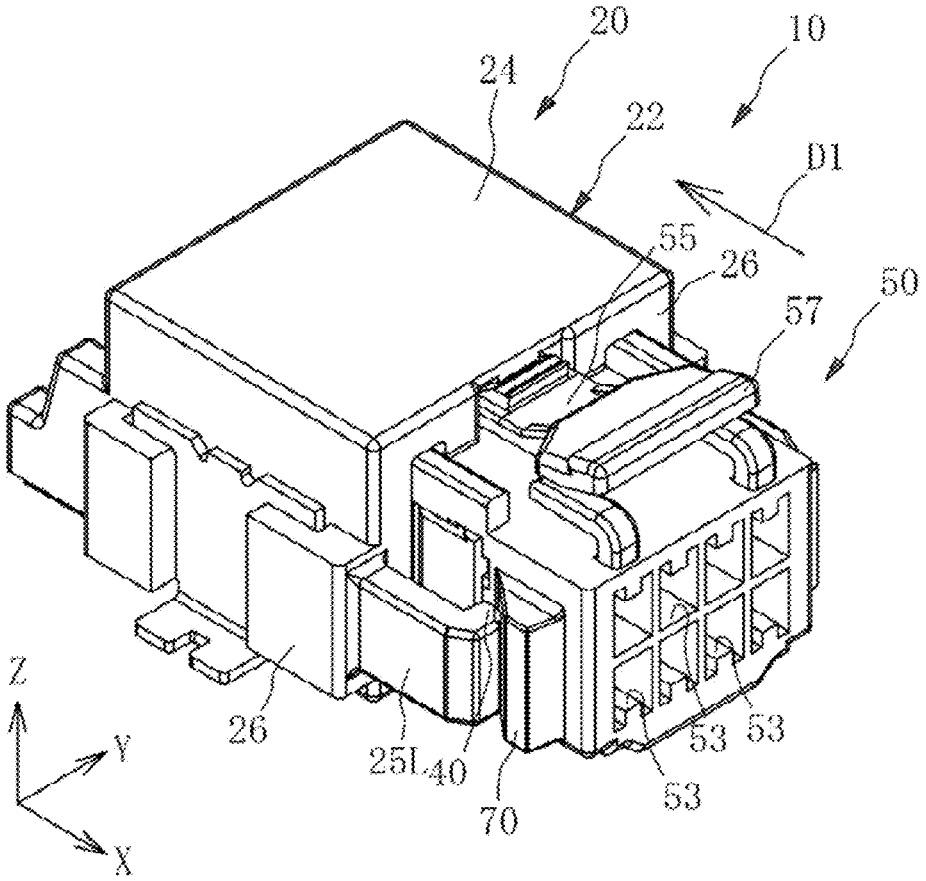
FIG. 1 is a perspective view illustrating a connector apparatus according to an embodiment of the present disclosure.
Figure 2:
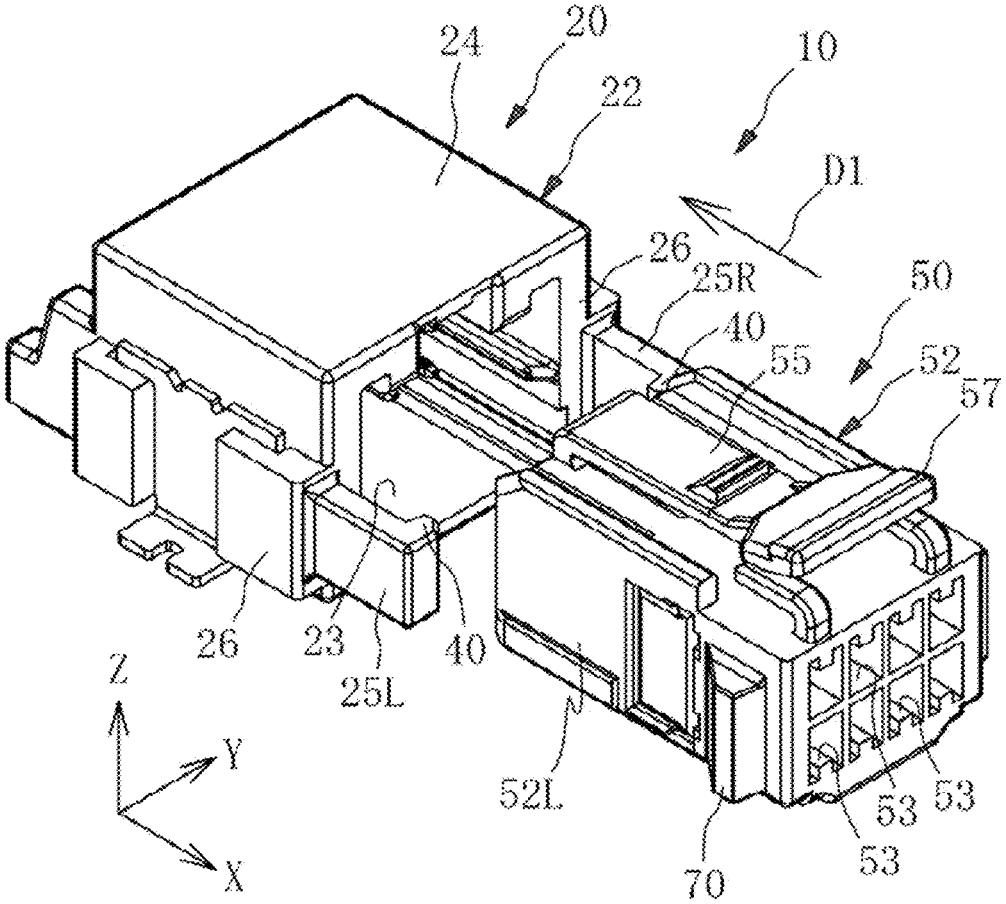
FIG. 2 is an exploded perspective view of the connector apparatus.

For example, the connector apparatus 10 is applied for an electric circuit component built in an automobile. As illustrated in FIGS. 1, 2, the connector apparatus 10 includes a first connector 20, and a second connector 50 to be engaged with the first connector 20. A fitting direction D1 in which the second connector 50 is fitted in the first connector 20 is the same direction as the −X direction.

Figure 3:
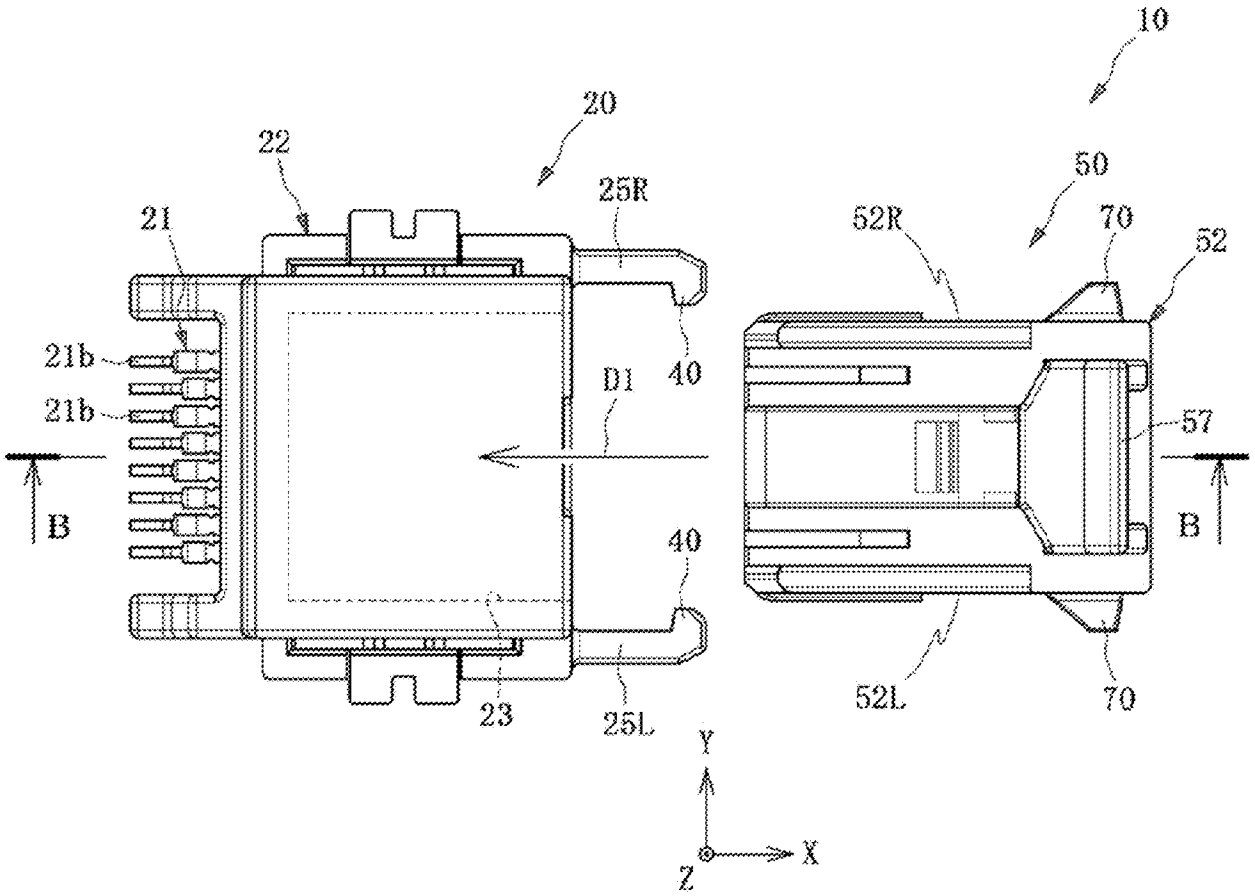
FIG. 3 is an exploded plan view of the connector apparatus.
Figure 4:
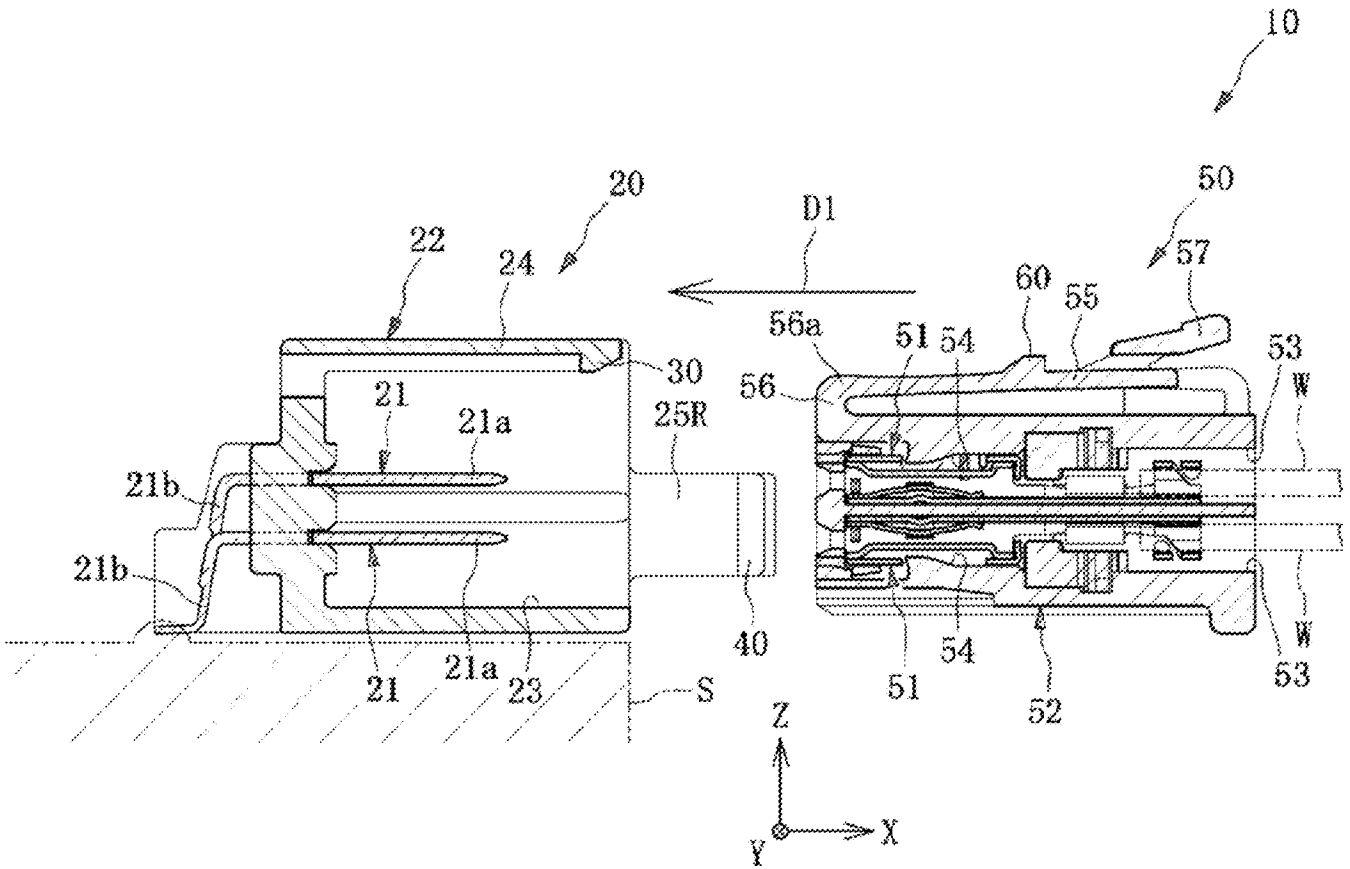
FIG. 4 is a cross-sectional view taken along a line B-B in FIG. 3.

As illustrated in FIGS. 3, 4, in this embodiment, the first connector 20 is a receptacle connector to be mounted on a wiring board S. The first connector 20 includes eight male terminals 21 each formed of a conductive material, and an outer housing 22 formed of a plastic material. The first connector 20 is formed by, for example, forming the outer housing 22 by injection molding, and then press-fitting the male terminals 21 therein.

As illustrated in FIG. 4, the male terminal 21 has an end 21*a* at the +X side and an end 21*b* at the −X side formed so as to protrude from the outer housing 22. The end 21*a* of the male terminal 21 at the +X side protrudes to the internal space of the outer housing 22. The end 21*b* of the male terminal 21 at the −X side is exposed from the rear end surface of the outer housing 22 at the −X side, is curved in the substantially S shape, and protrudes in parallel with the −X direction. The end 21*b* of the male terminal 21 is applied as an external lead to be soldered to the wiring board S.

The outer housing 22 is a component formed in a substantially box shape and formed with an engagement hole 23 opened in the +X direction. The second connector 50 is to be fitted in the engagement hole 23 of the outer housing 22. Formed near a celling wall 24 that is a part of a wall forming the outer housing 22 is a first latching part 30 at the +X side.

Figure 5:
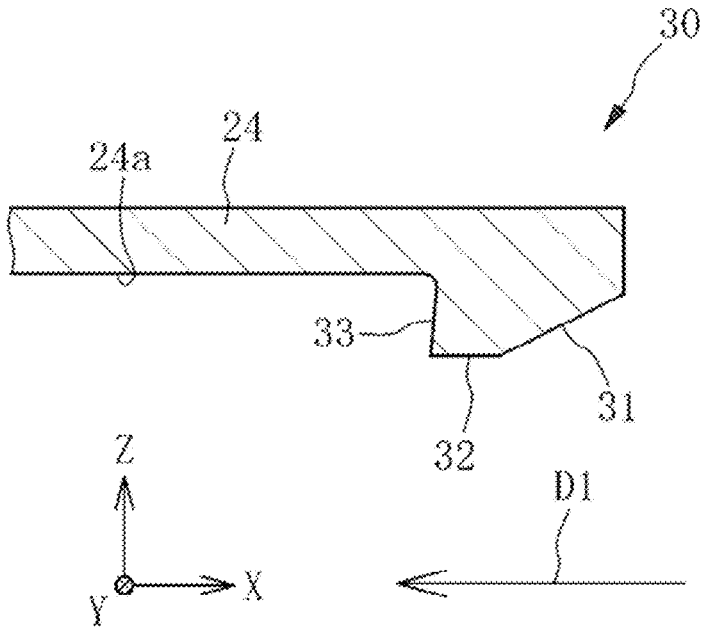
FIG. 5 is a cross-sectional view of a first latching part.

As illustrated in FIG. 5, the first latching part 30 is formed on a lower surface 24*a* of the celling wall 24. The first latching part 30 includes an inclined surface 31, a parallel surface 32, and a standing-upright surface 33 in sequence from the rear end side (+X side) in the fitting direction D1. The inclined surface 31 is inclined relative to the fitting direction D1. The parallel surface 32 is in parallel with the fitting direction D1. The standing-upright surface 33 is substantially in parallel with the Z-axis direction.

As illustrated in FIG. 3, the outer housing 22 is provided with a body part in which the engagement hole 23 is formed, a pair of arms 25R, 25L, and two second latching parts 40 provided at the respective leading ends of the arms 25R, 25L.

As illustrated in FIG. 2, the arms 25R, 25L are each a bar member formed so as to protrude in the +X direction from the end surface of a side wall 26 that is a part of the wall forming the outer housing 22. As illustrated in FIG. 1, the arms 25R, 25L are formed so as to be exposed to the exterior in an engaged condition and to be visible from the exterior for a user who attempts to engage the first connector 20 and the second connector 50. The arms 25R, 25L are deflected in accordance with an advancement of the engagement between the first connector 20 and the second connector 50.

Figure 6:
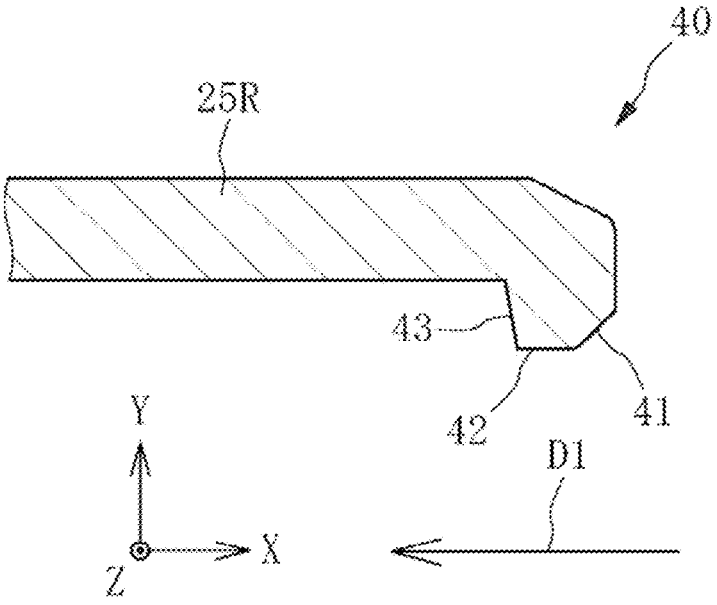
FIG. 6 is a cross-sectional view of a second latching part.

As illustrated in FIG. 3, the second latching parts 40 are formed so as to face with each other and inwardly relative to the pair of arms 25R, 25L. As illustrated in FIG. 6, the latching part 40 includes an inclined surface 41, a parallel surface 42, and a standing-upright surface 43 at the rear end side (+X side) in the fitting direction D1. The inclined surface 41 is inclined relative to the fitting direction D1. The parallel surface 42 is in parallel with the fitting direction D1. The standing-upright surface 43 is inclined relative to the Y-axis direction.

As illustrated in FIGS. 3, 4, in this embodiment, the second connector 50 is a plug connector to be connected to wirings W. The second connector 50 includes eight female terminals 51, and an inner housing 52 formed of a plastic material.

Figure 7:
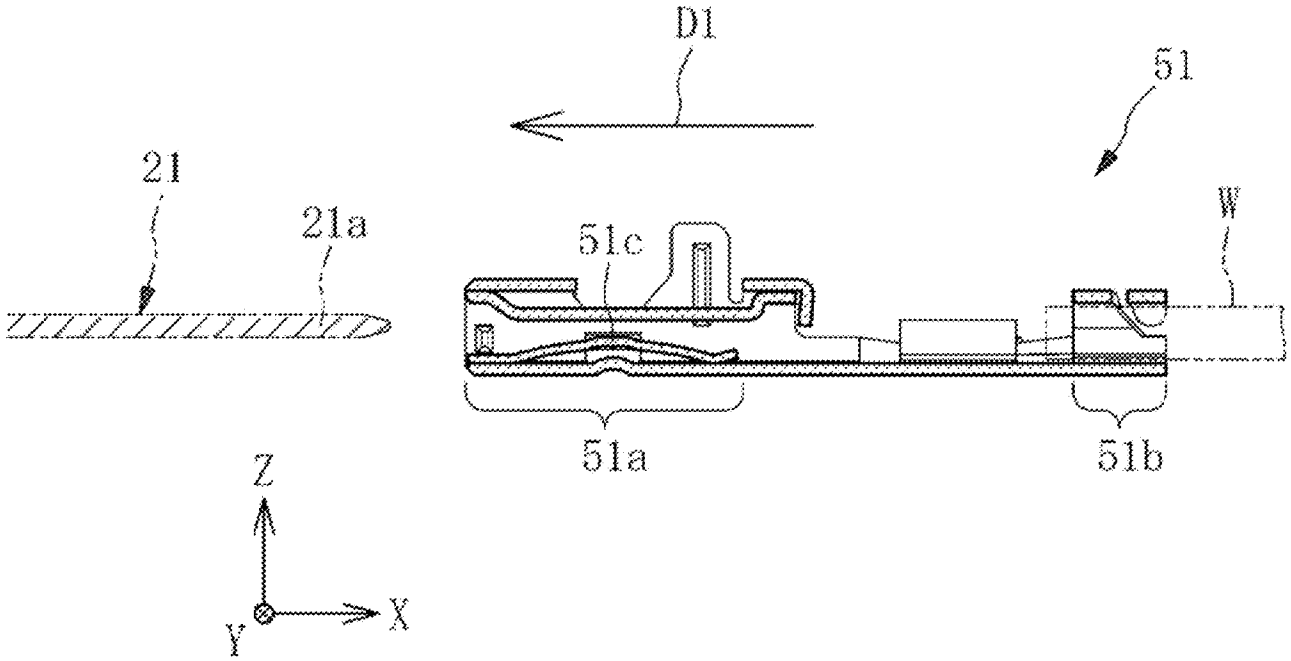
FIG. 7 is a cross-sectional view of a female terminal.

As illustrated in FIG. 7, the female terminal 51 is formed by, for example, bending a conductive plate member. Formed at the end of the female terminal 51 at the −X side is a sheath 51*a* in a substantially rectangular cylindrical shape in which the end 21*a* of the male terminal 21 is to be fitted. The end 21*a* of the male terminal 21 fitted in the sheath 51*a* is fastened by the elastic force of an elastic contact piece 51*c*. In addition, formed at the end of the female terminal 51 at the +X side is a tight-fit part 51*b* in which the wiring W is fitted and to which the wiring W is fastened with pressure.

As illustrated in FIG. 2, the inner housing 52 is formed in a substantially cuboid shape with the lengthwise direction that is substantially the X-axis direction. Formed in the rear end surface (the end surface at the +X side) of the inner housing 52 are eight fitting holes 53 in which the respective female terminals 51 are fitted. As illustrated in FIG. 4, the fitting hole 53 is in communication with a terminal retaining space 54 formed in the inner housing 52.

The inner housing 52 is formed with an arm 55, and a first latched part 60 provided thereon.

The arm 55 is elongated from a nearby part 56*a* to the leading end side (−X side) of a celling wall 56 that is a part of the wall forming the inner housing 52. The arm 55 is deflected in accordance with an advancement of the engagement between the first connector 20 and the second connector 50.

Figure 8:
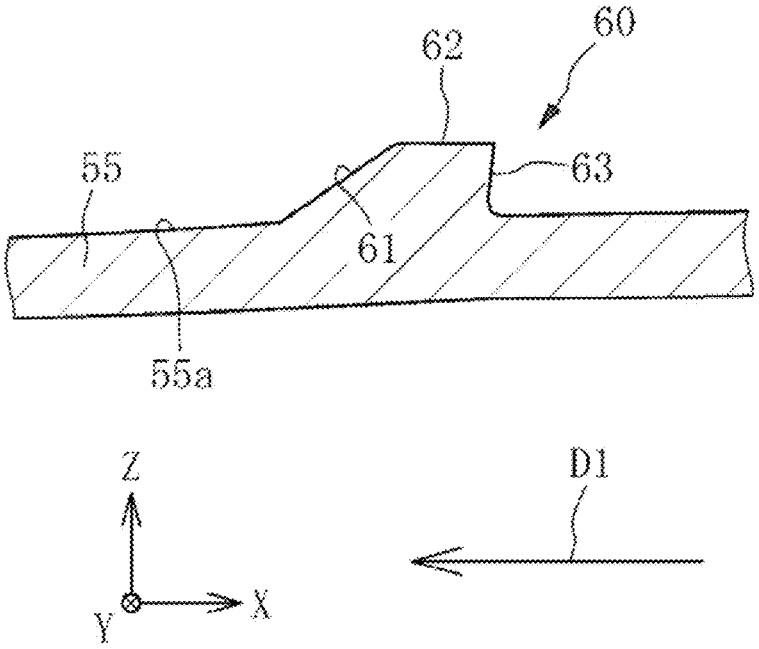
FIG. 8 is a cross-sectional view of a first latched part.

The first latched part 60 is to be latched with the first latching part 30 when the first connector 20 and the second connector 50 are engaged with each other. As illustrated in FIG. 8, the first latched part 60 is formed on an upper surface 55*a* of the arm 55. The first latched part 60 includes an inclined surface 61, a parallel surface 62, and a standing-upright surface 63 in sequence from the leading end side (−X side) in the fitting direction D1 of the second connector 50. The inclined surface 61 is inclined relative to the fitting direction D1. The inclination angle of the inclined surface 61 is equal to that of the inclined surface of the first latching part 30. The parallel surface 62 is substantially in parallel with the fitting direction D1. The inclined surface 61 and the parallel surface 62 are applied as guide surfaces that guide the first latching part 30 in accordance with an advancement of the engagement between the first connector 20 and the second connector 50. The standing-upright surface 63 is substantially vertical to the fitting direction D1 (substantially in parallel with the Z-axis direction). When the standing-upright surface 63 faces the standing-upright surface 33 of the first latching part 30, the first latched part 60 is latched by the first latching part 30.

As illustrated in FIGS. 2, 4, formed near the leading end of the arm 55 of the inner housing 52 is a latch unlocking part 57 to unlock the latching between the first latching part 30 and the first latched part 60.

As illustrated in FIG. 3, the inner housing 52 is formed with two second latched parts 70.

Figure 9:
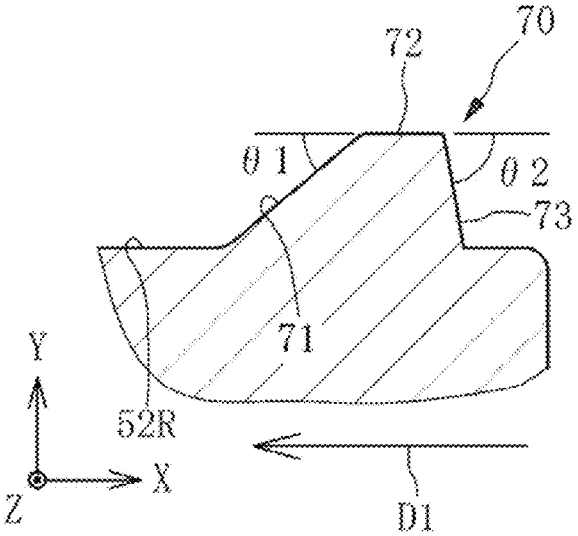
FIG. 9 is a cross-sectional view of a second latched part.
Figure 10A:
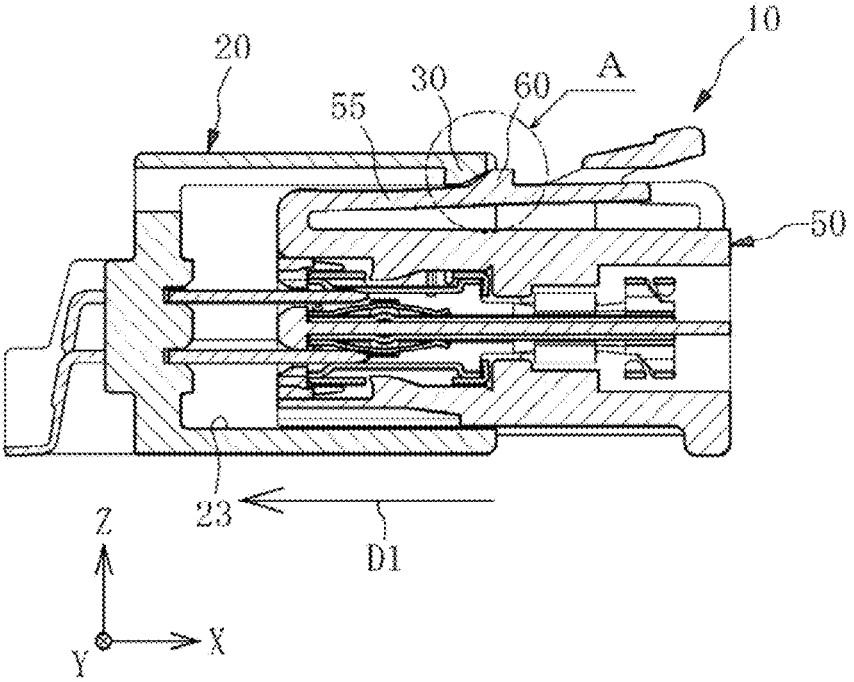
FIG. 10A is a (first) cross-sectional view for explaining an engagement between a first connector and a second connector.
Figure 10B:
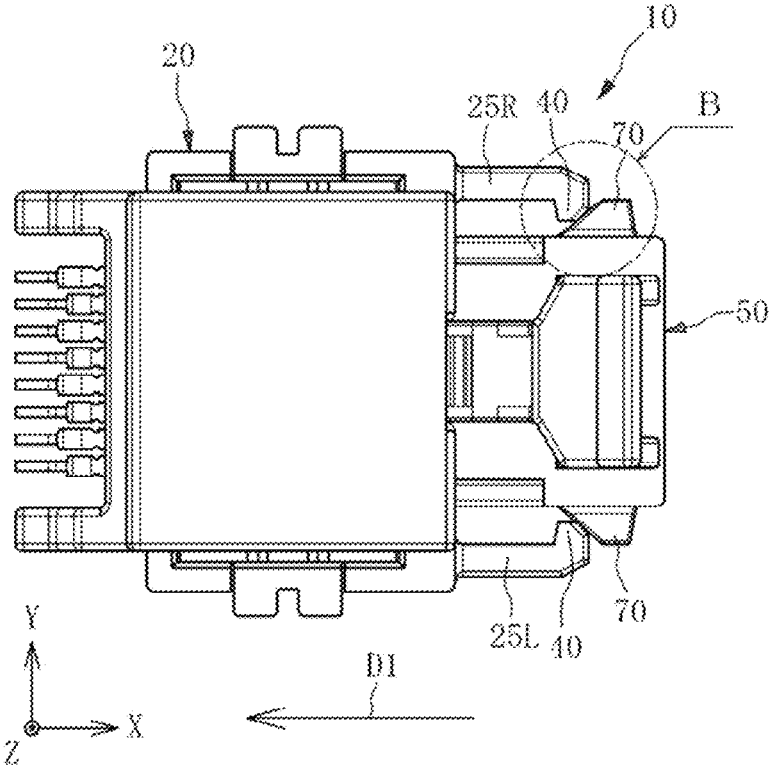
FIG. 10B is a (first) plan view for explaining an engagement between the first connector and the second connector.
Figure 11A:
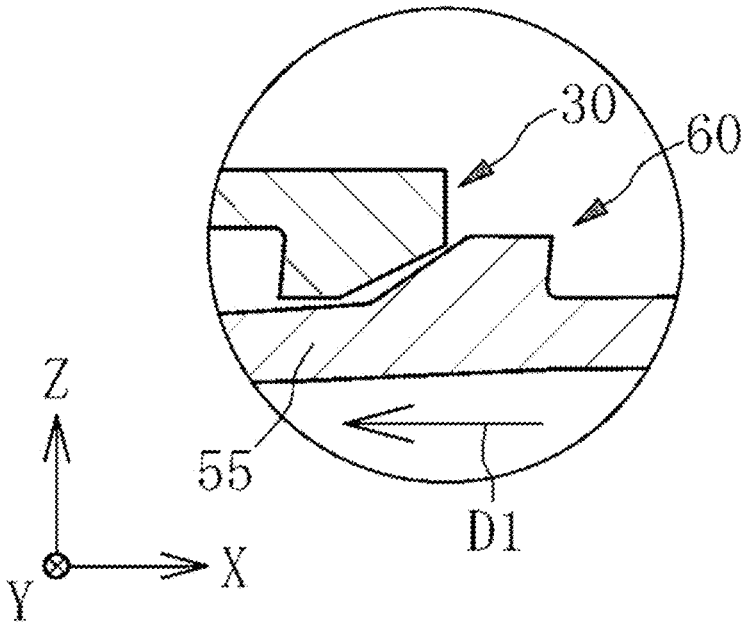
FIG. 11A is a (first) cross-sectional view illustrating a portion indicated by an arrow A in FIG. 10A in an enlarged manner.
Figure 11B:
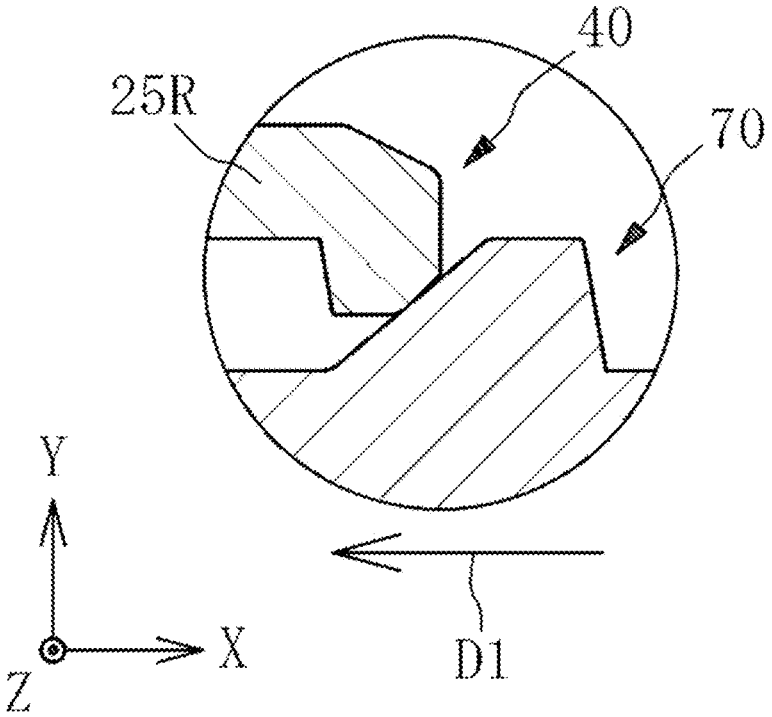
FIG. 11B is a (first) cross-sectional view illustrating a portion indicated by an arrow B in FIG. 10B in an enlarged manner.

The second latched parts 70 are to be latched with the respective second latching parts 40 in accordance with an advancement of the engagement between the first connector 20 and the second connector 50. The second latched parts 70 are formed at respective side surfaces 52R, 52L of the inner housing 52. As illustrated in FIG. 9, the second latched parts 70 each include an inclined surface 71, a parallel surface 72, and a standing-upright surface 73 in sequence from the leading end side (−X side) in the fitting direction D1 of the second connector 50. The inclined surface 71 is inclined relative to the fitting direction D1. The parallel surface 72 is substantially in parallel with the fitting direction D1. The standing-upright surface 73 is inclined relative to the fitting direction D1. The inclined surface 71 and the parallel surface 72 are applied as guide surfaces that guide the second latching part 40 in accordance with an advancement of the engagement between the first connector 20 and the second connector 50. The standing-upright surface 73 has a larger inclination angle θ2 than an inclination angle θ1 of the inclined surface 71. When the standing-upright surface 73 faces the standing-upright surface 43 of the second latching part 40, the second latched part 70 is latched by the corresponding second latching part 40.

Next, how to engage the first connector 20 and the second connector 50 in the connector apparatus 10 employing the above structure will be explained with reference to FIGS. 10A to 19B.

As illustrated in FIGS. 10A, 10B and FIGS. 11A, 11B, when the second connector 50 is moved in the fitting direction D1, and the second connector 50 is caused to be fitted in the engagement hole 23 of the first connector 20, the first latching part 30 abuts the first latched part 60. When the first latching part 30 abuts the first latched part 60, the second latching parts 40 also abut the respective second latched parts 70. In this embodiment, the timing at which the first latching part 30 abuts the first latching part 60 is the same timing at which the second latching parts 40 abut the respective second latched parts 70.

Figure 12A:
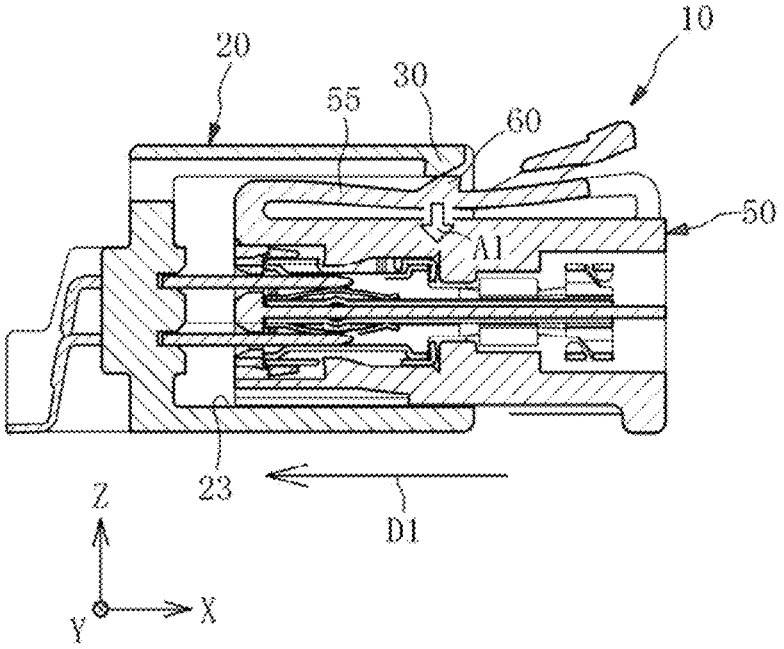
FIG. 12A is a (second) cross-sectional view for explaining an engagement between the first connector and the second connector.
Figure 12B:
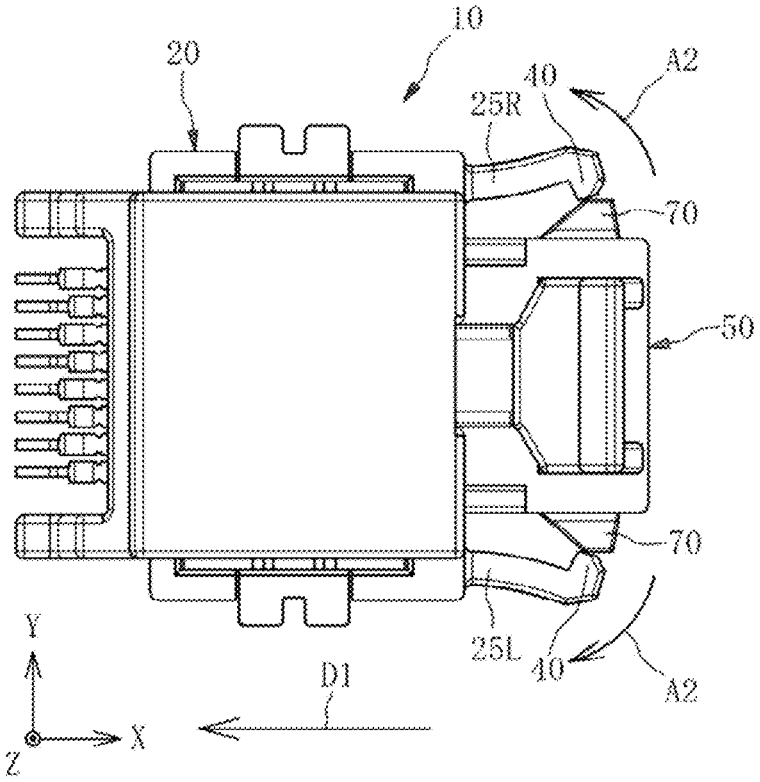
FIG. 12B is a (second) plan view for explaining an engagement between the first connector and the second connector.
Figure 13A:
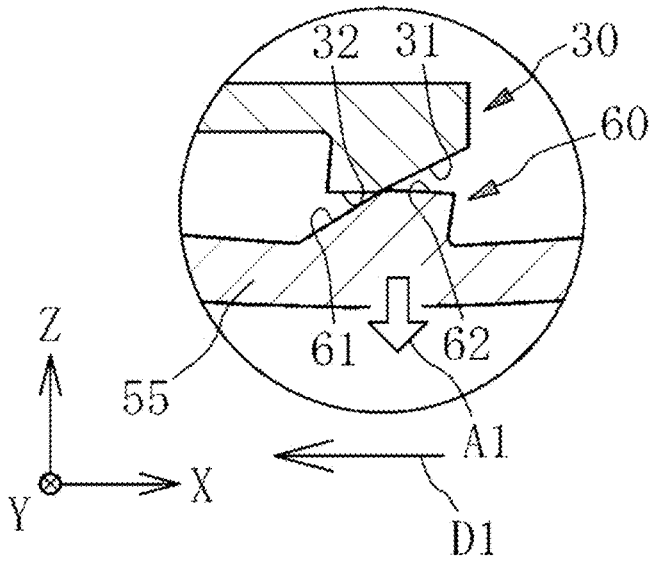
FIG. 13A is a (second) partial enlarged cross-sectional view of FIG. 12A.
Figure 13B:
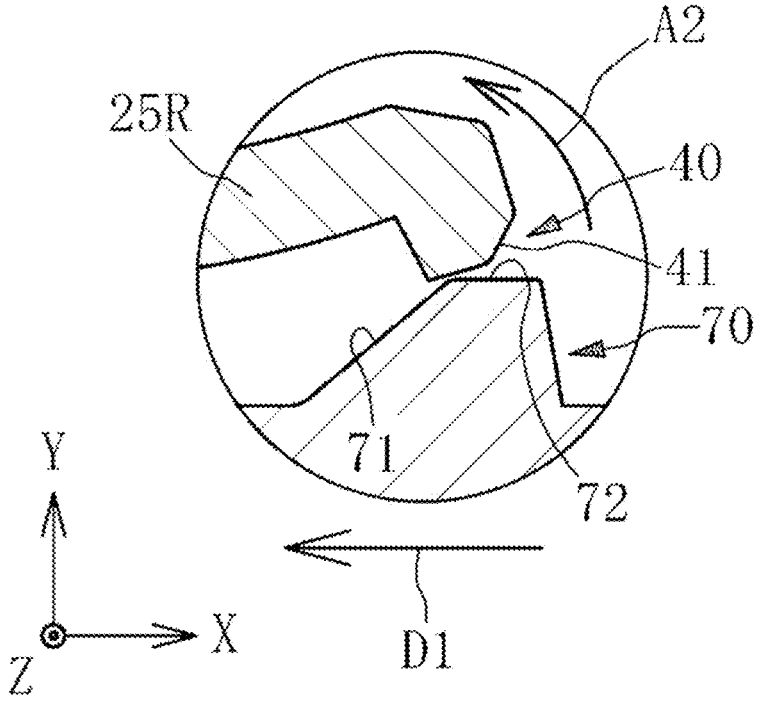
FIG. 13B is a (second) partial enlarged cross-sectional view of FIG. 12B.
Figure 14A:
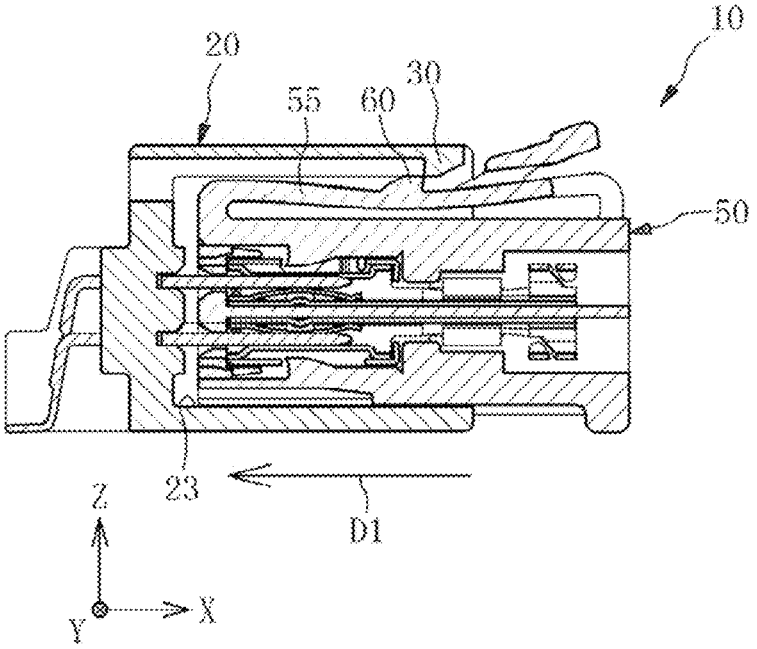
FIG. 14A is a (third) cross-sectional view for explaining an engagement between the first connector and the second connector.
Figure 14B:
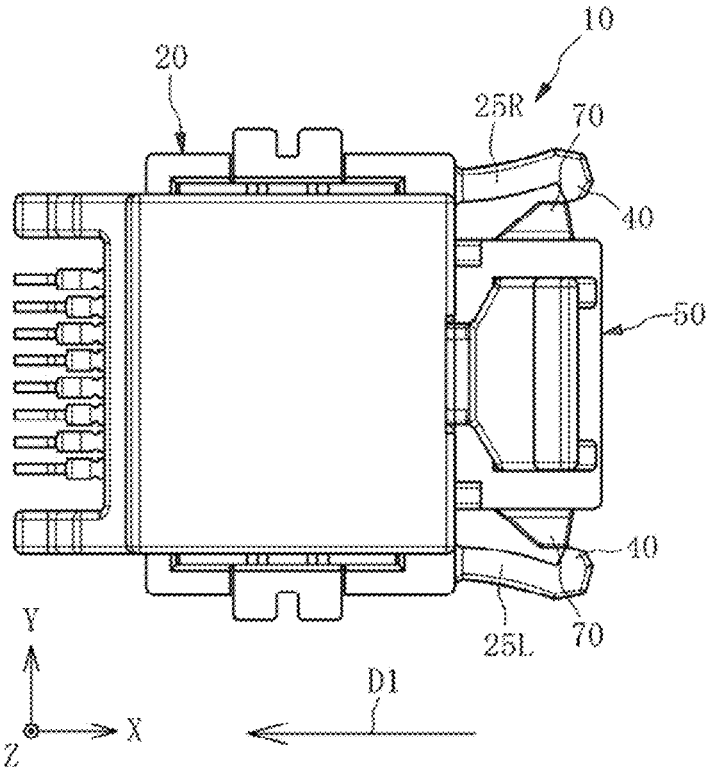
FIG. 14B is a (third) plan view for explaining an engagement between the first connector and the second connector.
Figure 15A:
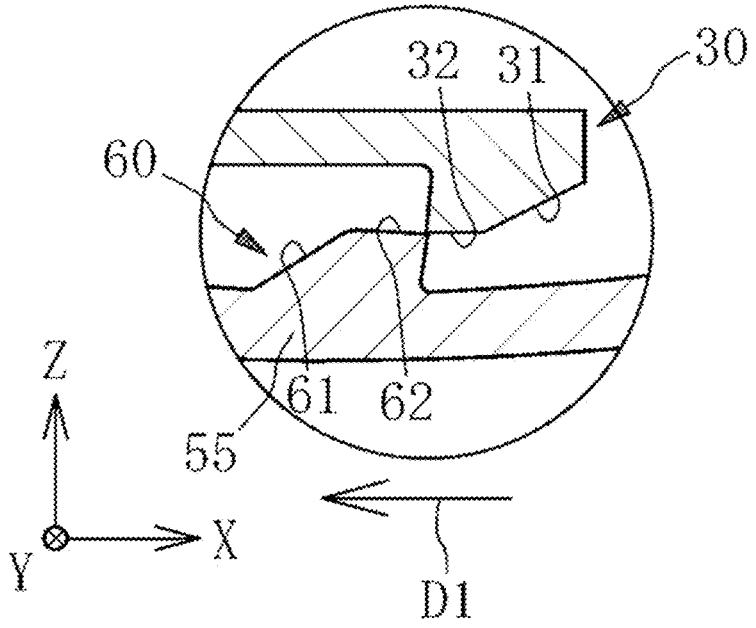
FIG. 15A is a (third) partial enlarged cross-sectional view of FIG. 14A.
Figure 15B:
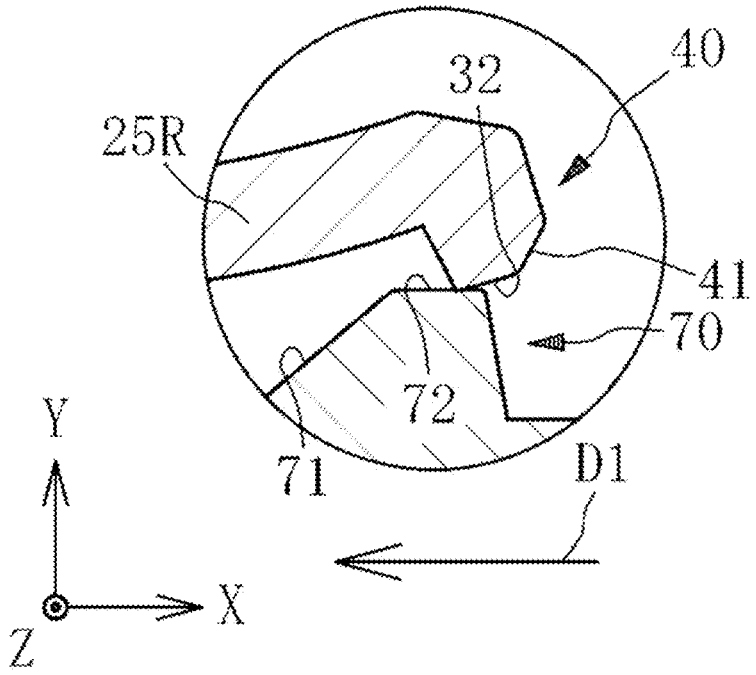
FIG. 15B is a (third) partial enlarged cross-sectional view of FIG. 14B.
Figure 16A:
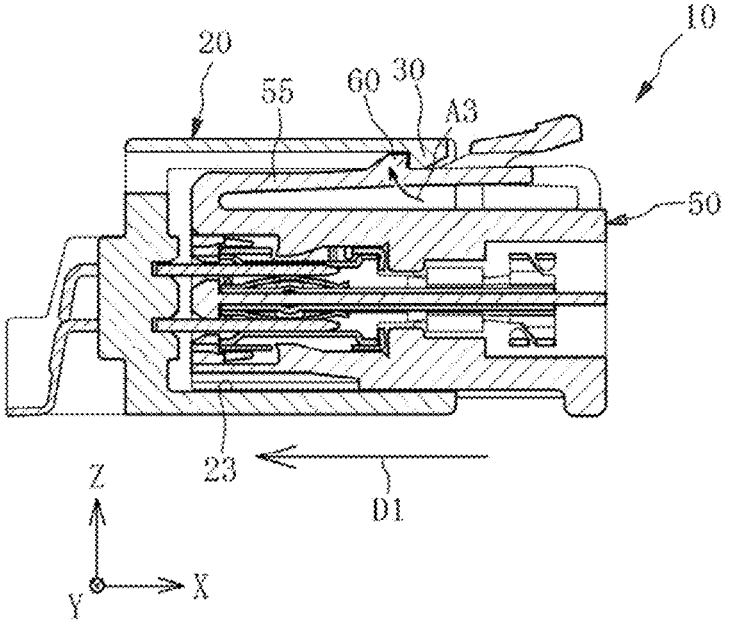
FIG. 16A is a (fourth) cross-sectional view for explaining an engagement between the first connector and the second connector.
Figure 16B:
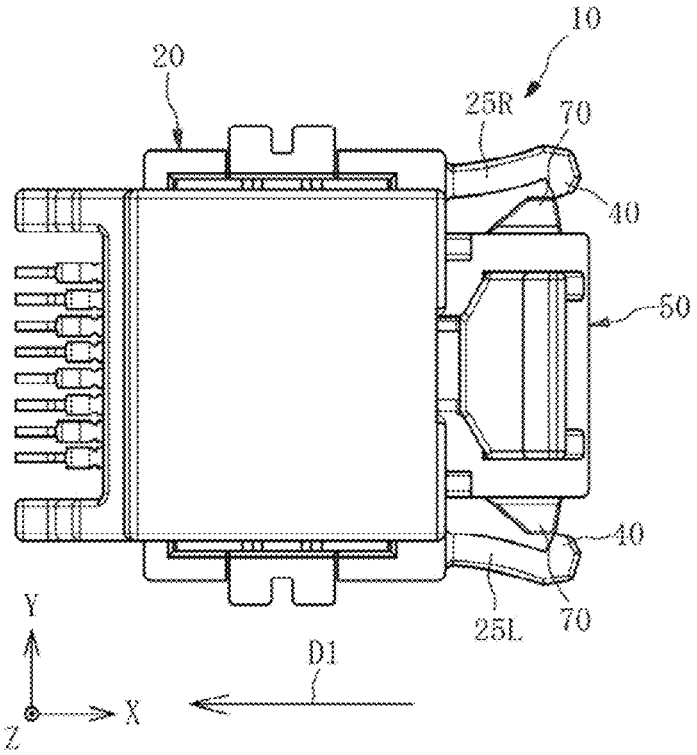
FIG. 16B is a (fourth) plan view for explaining an engagement between the first connector and the second connector.
Figure 17A:
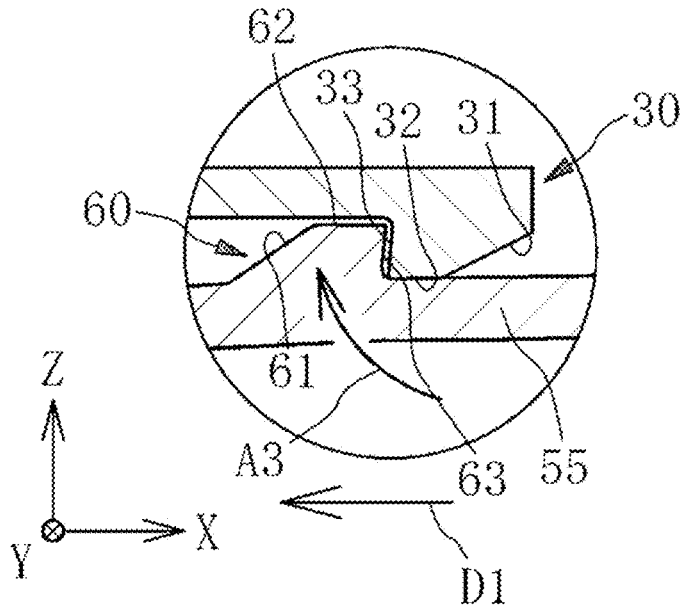
FIG. 17A is a (fourth) partial enlarged cross-sectional view of FIG. 16A.
Figure 17B:
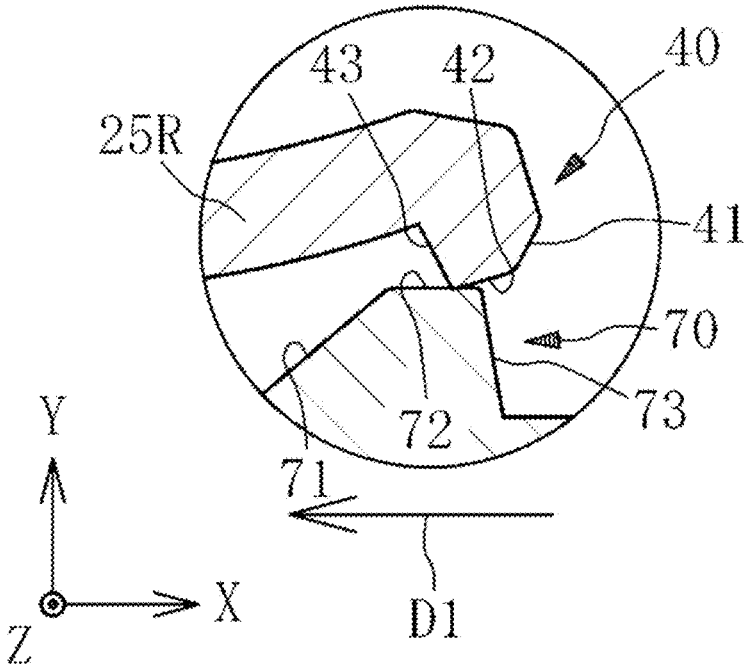
FIG. 17B is a (fourth) partial enlarged cross-sectional view of FIG. 16B.

When the second connector 50 is further fitted in the engagement hole 23 of the first connector 20, as illustrated in FIGS. 12A, 13A, the first latching part 30 is guided by the inclined surface 61 of the first latched part 60, and thus the arm 55 is deflected, and the first latched part 60 is pushed downwardly (−Z side) as indicated by an arrow A1. Likewise, as illustrated in FIGS. 12B, 13B, the second latching parts 40 are guided by the inclined surfaces 71 of the respective second latched parts 70, and thus the arms 25R, 25L are deflected, and the second latching parts 40 are pushed out in the direction spreading from each other as indicated by an arrow A2.

When the second connector 50 is still further fitted in the engagement hole 23 of the first connector 20, as illustrated in FIG. 13A, the first latching part 30 reaches the parallel surface 62 of the first latched part 60. When the first latching part 30 reaches the parallel surface 62 of the first latched part 60, as illustrated in FIG. 13B, the second latching parts 40 also reach the parallel surfaces 72 of the respective second latched parts 70. In this embodiment, the timing at which the first latching part 30 reaches the parallel surface 62 is the same timing at which the second latching parts 40 reach the respective parallel surfaces 72.

When the second connector 50 is yet further fitted in the engagement hole 23 of the first connector 20, as illustrated in FIGS. 14A to 15B, the first latching part 30 is guided along the parallel surface 62 of the first latched part 60, while at the same time, the second latched parts 40 are guided along the parallel surfaces 72 of the respective second latched parts 70.

When the second connector 50 is further fitted in the engagement hole 23 of the first connector 20 from the above condition, as illustrated in FIGS. 16A to 17B, the first latching part 30 reaches the standing-upright surface 63 of the first latched part 60. When the first latching part 30 reaches the standing-upright surface 63, the deflection of the arm 55 is canceled, and thus the first latched part 60 is returned to the upper side (+Z side) as indicated by an arrow A3 based on the elastic action of the arm 55. Consequently, the standing-upright surface 33 of the first latching part 30 faces the standing-upright surface 63 of the first latched part 60, and thus the first latched part 60 is latched by the first latching part 30. At the time point at which the first latching part 30 reaches the standing-upright surface 63, the second latching part 40 has not reached the standing-upright surface 73 of the second latched part 70 yet, and is still being guided by the parallel surface 72.

When the second connector 50 is still further fitted in the engagement hole 23 of the first connector 20, as illustrated in FIGS. 18A to 19B, the second latching parts 40 reach the standing-upright surfaces 73 of the respective second latched parts 70. When the second latching parts 40 reach the respective standing-upright surfaces 73, the deflections of the arms 25R, 25L are canceled, and the second latching parts 40 move as indicated by an arrow A4 based on the elastic actions of the arms 25R, 25L. Consequently, the standing-upright surface 43 of the second latching part 40 faces the standing-upright surface 73 of the second latched part 70, and thus the second latched parts 70 are latched by the respective second latching parts 40. Since the first latched part 60 is further moved in the fitting direction D1, the gap between the standing-upright surface 33 of the first latching part 30 and the standing-upright surface 63 of the first latched part 60 spreads.

Figure 18A:
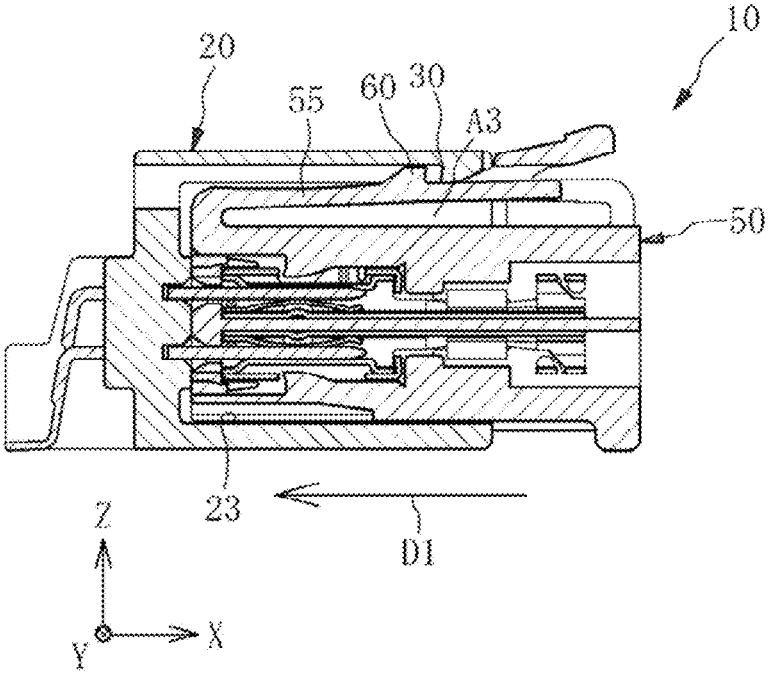
FIG. 18A is a (fifth) cross-sectional view for explaining an engagement between the first connector and the second connector.
Figure 18B:
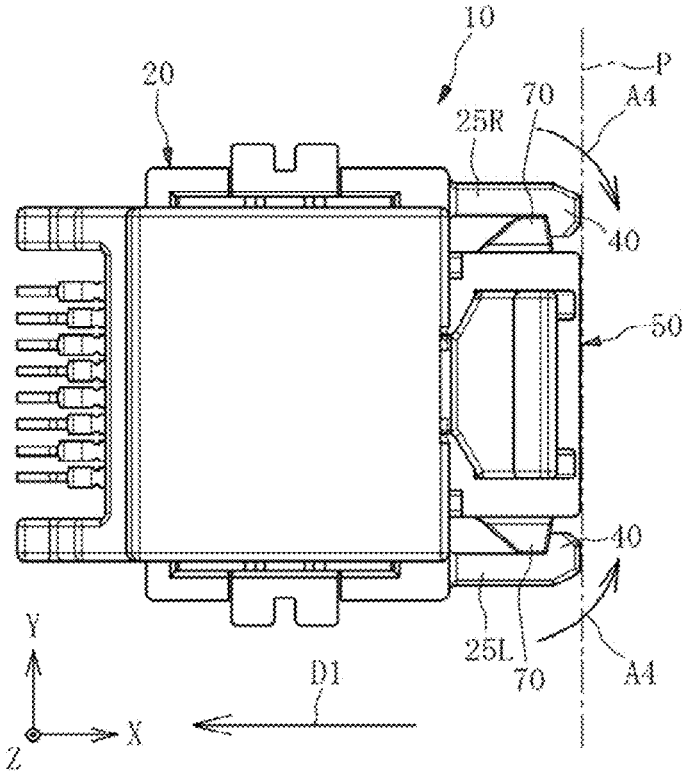
FIG. 18B is a (fifth) plan view for explaining an engagement between the first connector and the second connector.
Figure 19A:
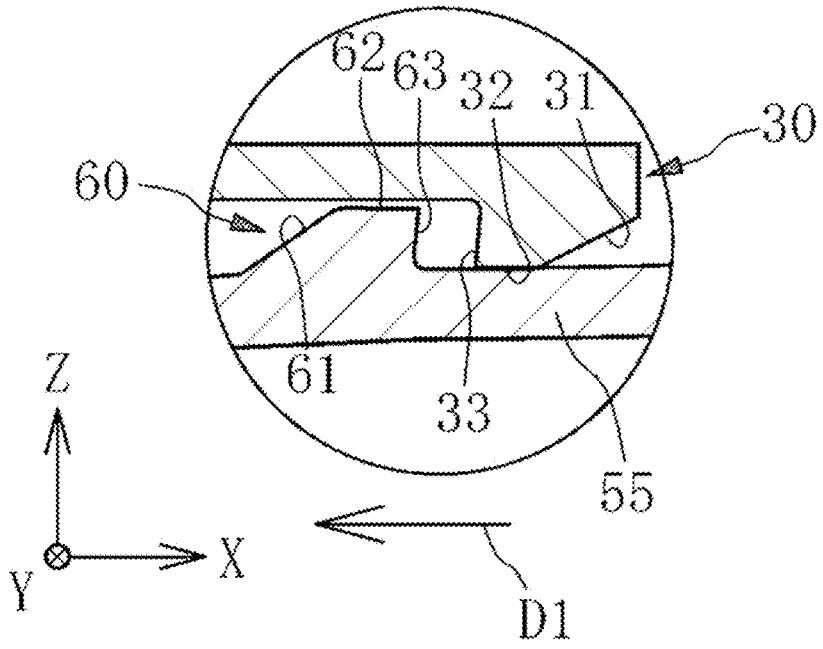
FIG. 19A is a (fifth) partial enlarged cross-sectional view of FIG. 18A.
Figure 19B:
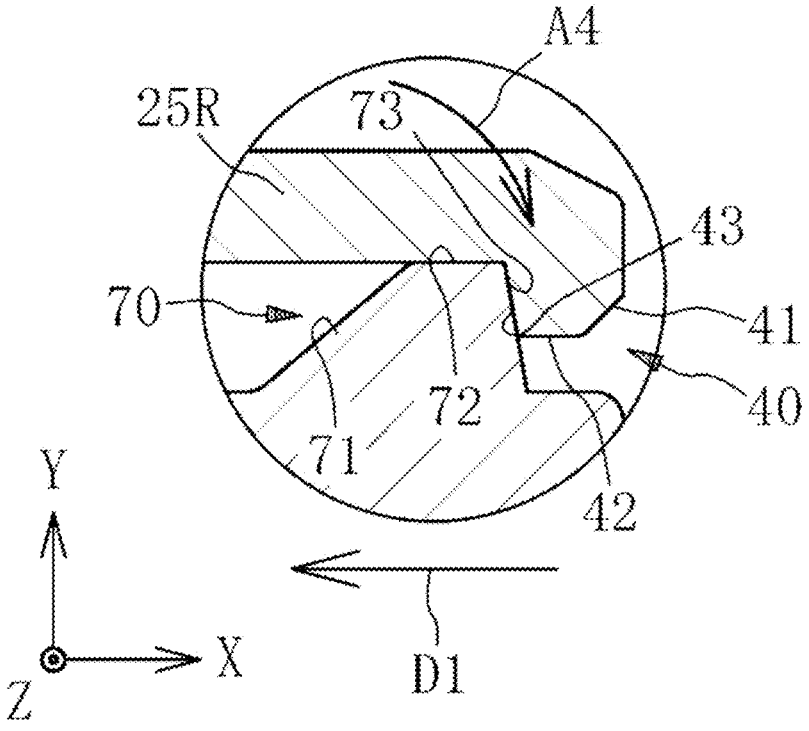
FIG. 19B is a (fifth) partial enlarged cross-sectional view of FIG. 18B.

The engagement between the first connector 20 and the second connector 50 completes through the above actions. At the time point at which the engagement completes, the location of the rear end of the second connector 50 in the fitting direction D1 and the location of the leading ends of the respective arms 25R, 25L protruding from the body of the first connector 20 are on a same plane P orthogonal to the fitting direction D1 as illustrated in FIG. 18B.

Next, how to detach the second connector 50 from the first connector 20 in the connector apparatus 10 will be explained with reference to FIGS. 20A, 20B. A detaching direction D2 in which the second connector 50 is pulled out from the first connector 20 is the same direction as the +X direction.

Figure 20A:
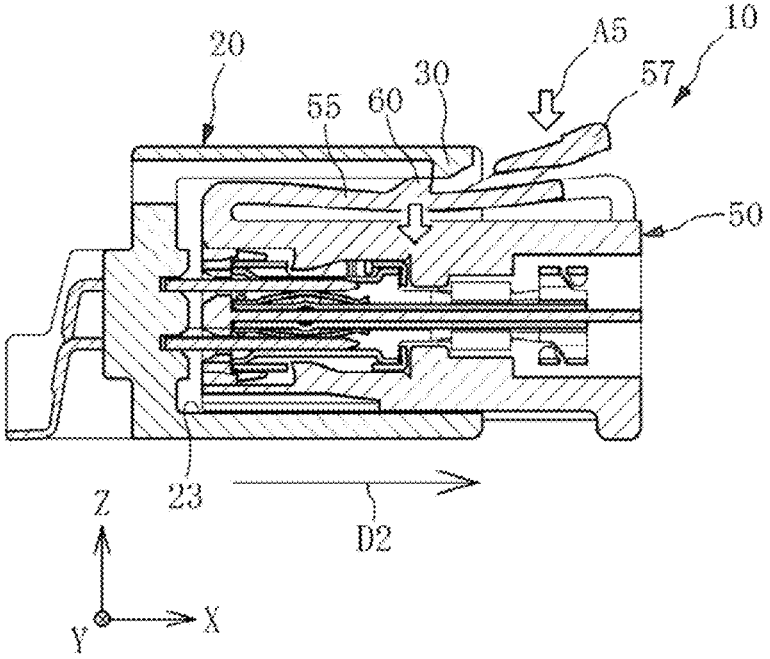
FIG. 20A is a cross-sectional view for explaining an unlocking of the engagement between the first connector and the second connector.
Figure 20B:
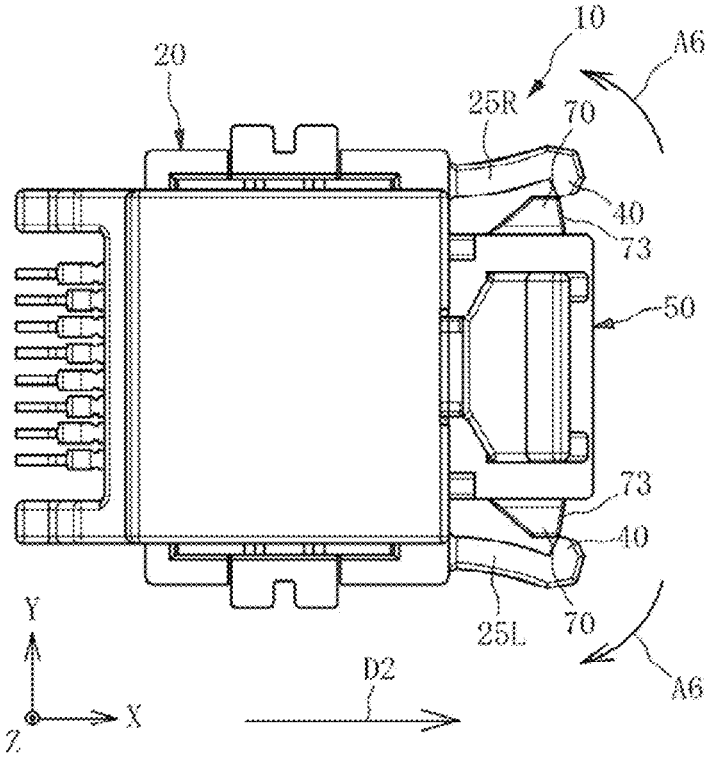
FIG. 20B is a plan view for explaining the unlocking of the engagement between the first connector and the second connector.

In order to unlock the engagement between the first connector 20 and the second connector 50, first, as illustrated in FIG. 20A, the latch unlocking part 57 of the second connector 50 is depressed as indicated by an arrow A5. This causes the arm 55 to be deflected, and thus the first latched part 60 is pushed downwardly (−Z side). Consequently, the latching between the first latching part 30 and the first latched part 60 is unlocked.

Next, the second connector 50 is moved in the detaching direction D2, and is pulled out from the first connector 20. As illustrated in FIG. 20B, this causes the second latching parts 40 to be guided by the standing-upright surfaces 73 of the respective second latched parts 70, and thus the arms 25R, 25L are deflected. Hence, as indicated by an arrow A6, the second latching parts 40 are pushed out in a direction spreading from each other. Since the standing-upright surface 73 includes an inclined surface inclined in the X-axis direction, the arms 25R, 25L are facilitated to be deflected in the direction in which the second latching parts 40 spread from each other. Consequently, the latching between the second latching parts 40 and the respective second latched parts 70 are unlocked. Subsequently, the second connector 50 is pulled out, and is detached from the first connector 20.

Figure 21:
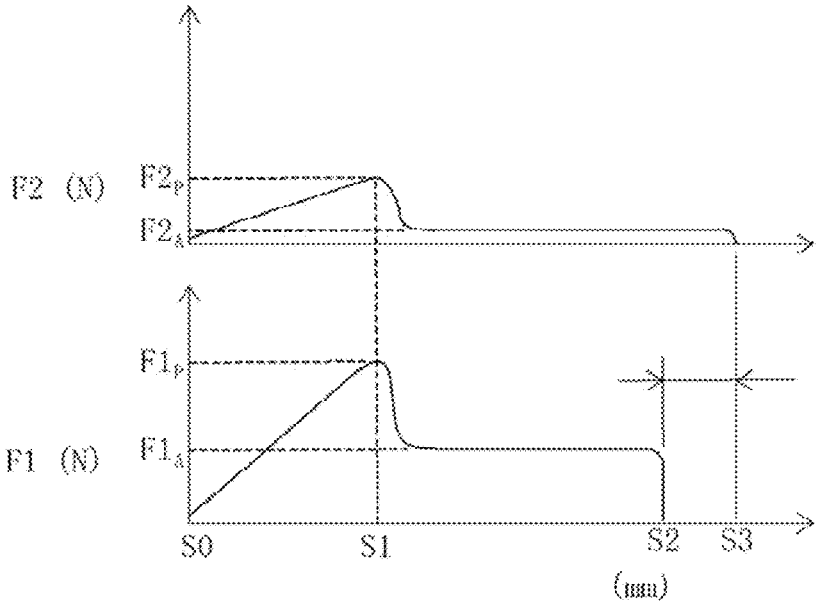
FIG. 21 is a graph illustrating a relationship among an engagement stroke, a fitting force when the first latched part is latched by the first latching part, and a fitting force when the second latched part is latched by the second latching part.

FIG. 21 is a graph illustrating a relationship among an engagement stroke, a fitting force F1 when the first latched part 60 is latched by the first latching part 30, and a fitting force F2 when the second latched part 70 is latched by the second latching part 40. As is clear from FIG. 21, when the second connector 50 is moved in the fitting direction D1 and the second connector 50 is fitted in the engagement hole 23 of the first connector 20 to an engagement stroke S0 (the position of the second connector 50 in FIGS. 10A to 11B), the first latching part 30 abuts the first latched part 60, while at the same time, the second latching parts 40 abut the respective second latched parts 70.

When the second connector 50 is further moved from the engagement stroke S0 to an engagement stroke S1, the first latching part 30 is guided by the inclined surface 61 of the first latched part 60, and the second latching parts 40 are guided by the inclined surfaces 71 of the respective second latched parts 70 (see FIGS. 12A to 13B). Hence, the fitting forces F1, F2 start increasing substantially in proportional to the inclination angles of the inclined surfaces 31, 61.

When the second connector 50 is still further moved up to the engagement stroke S1 (the position of the second connector 50 in FIGS. 12A to 13B), the first latching part 30 reaches the parallel surface 62, and the second latching parts 40 reach the respective parallel surfaces 72. At this time, the fitting forces F1, F2 increase up to respective peak fitting forces $F1_P$, $F2_P$. Since the timing at which the first latching part 30 reaches the parallel surface 62 is the same timing at which the second latching parts 40 reach the respective parallel surfaces 72, the timings at which the fitting forces F1, F2 become the respective peak fitting forces $F1_P$, $F2_P$ are consistent.

When the second connector 50 is yet still further moved from the engagement stroke S1 to an engagement stroke S2 (the position of the second connector 50 in FIGS. 16A to 17B), the first latching part 30 moves along the parallel surface 62 of the first latched part 60, and the second latching parts 40 move along the parallel surfaces 72 of the respective second latched parts 70. Hence, the fitting forces F1, F2 decrease from $F1_P$, $F2_P$, and transition at $F1_A$, $F2_A$ that are slightly smaller than the peak fitting forces $F1_P$, $F2_P$, respectively.

When the second connector 50 is moved up to the engagement stroke S2, the first latching part 30 reaches the standing-upright surface 63 of the first latched part 60, and latches the first latched part 60. Hence, the fitting force F1 becomes zero.

When the second connector 50 is further moved to an engagement stroke S3 (the position of the second connector 50 in FIGS. 18A to 19B), the second latching parts 40 reach the respective standing-upright surfaces 73, and latch the respective second latched parts 70. Hence, the fitting force F2 becomes zero.

As explained above, according to this embodiment, upon completion of the engagement between the first connector 20 and the second connector 50, the deflections of the arms 25R, 25L which are visible from the exterior are canceled. This enables the user to visually check the cancel of the deflections of the arms 25R, 25L, and to detect an incomplete engagement between the first connector 20 and the second connector 50. Consequently, when the first connector 20 is engaged with the second connector 50, an incomplete engagement that is an insufficient engagement between the first connector 20 and the second connector 50 is preventable.

More specifically, according to this embodiment, after the first latched part 60 is latched by the first latching part 30, the second latched parts 70 are latched by the respective second latching parts 40. Hence, an incomplete engagement that is a condition in which the first latched part 60 is not latched by the first latching part 30 but only the second latched parts 70 are latched by the second latching parts 40 is preventable. In addition, an incomplete engagement that is a condition in which only the first latched part 60 is latched by the first latching part 30 but the second latched parts 70 are not latched by the respective second latching parts 40 is also preventable upon checking the deflected conditions of the arms 25R, 25L. Consequently, the incomplete engagement in which the first latching part 30 does not fully latch and also the incomplete engagement in which the second latching parts 40 do not fully latch are both preventable.

In this embodiment, the standing-upright surface 33 of the first latching part 30 and the standing-upright surface 63 of the first latched part 60 have functions like "wedges" that maintain the latched conditions. Hence, according to this embodiment, an incomplete engagement between the first connector 20 and the second connector 50 caused by vibration of devices to which the connector apparatus 10 is applied is preventable. In addition, in order to prevent the incomplete engagement, additional components are unnecessary to the first connector 20 and the second connector 50, and thus an increase in the number of components, and that of the assembling procedures are suppressed. Consequently, the manufacturing costs are reduced.

In addition, according to this embodiment, while the second connector 50 is being fitted in the engagement hole 23 of the first connector 20, when the first latching part 30 abuts the first latched part 60, the second latching parts 40 also abut the respective second latched parts 70. Hence, the timings at which the fitting forces F1, F2 illustrated in FIG. 21 increase are consistent. Accordingly, the user is capable of engaging the first connector 20 with the second connector 50 with a feeling similar to those of connector apparatuses that have a single latching mechanism. Consequently, the workability is improved.

Still further, according to this embodiment, while the second connector 50 is being fitted in the engagement hole 23 of the first connector 20, when the first latching part 30 reaches the parallel surface 62 of the first latched part 60, the second latching parts 40 also reach the parallel surfaces 72 of the respective second latched parts 70. Hence, the timings at which the fitting forces F1, F2 become the peak forces $F1_P$, $F2_P$ as illustrated in FIG. 21 are consistent. Accordingly, the user is capable of engaging the first connector 20 with the second connector 50 with a feeling similar to those of connector apparatuses that have a single latching mechanism. Consequently, the workability is improved.

Yet still further, according to this embodiment, as illustrated in FIG. 18B, the position of the rear end of the second connector 50 in the fitting direction D1 and those of the leading ends of the arms 25R, 25L protruding from the body of the first connector 20 are on the same plane P orthogonal to the fitting direction D1 when the engagement between the first connector 20 and the second connector 50 completes. This facilitates the user to check whether or not the engagement between the first connector 20 and the second connector 50 completes, and to detect an incomplete engagement therebetween. Consequently, the incomplete engagement that is a condition in which the engagement between the first connector 20 and the second connector 50 is insufficient is preventable.

Moreover, according to this embodiment, after the first latched part 60 is latched by the first latching part 30 and until the second latched parts 70 are latched by the respective second latching parts 40, the arms 25R, 25L are deflected in a direction spreading from each other. This facilitates the user to check the deflected conditions of the arms 25R, 25L from, for example, the upper side (+Z side) of the connector apparatus 10, and to find the incomplete engagement that is a condition in which the engagement between the first connector 20 and the second connector 50 is insufficient. This enables a detection of the incomplete engagement between the first connector 20 and the second connector 50. Consequently, the incomplete engagement between the first connector 20 and the second connector 50 is preventable.

Furthermore, according to this embodiment, the standing-upright surface 73 of the second latched part 70 includes a surface inclined relative to the fitting direction D1. This facilitates the arms 25R, 25L to deflect in the direction in which the second latching parts 40 spread from each other. Accordingly, the unlocking of the latching between the second latching parts 40 and the respective second latched parts 70 becomes a smooth action. Consequently, the workability of pulling out the second connector 50 and detaching the second connector 50 from the first connector 20 is improved.

The embodiment of the present disclosure has been explained above, but the present disclosure is not limited to the above embodiment.

Figure 22A:
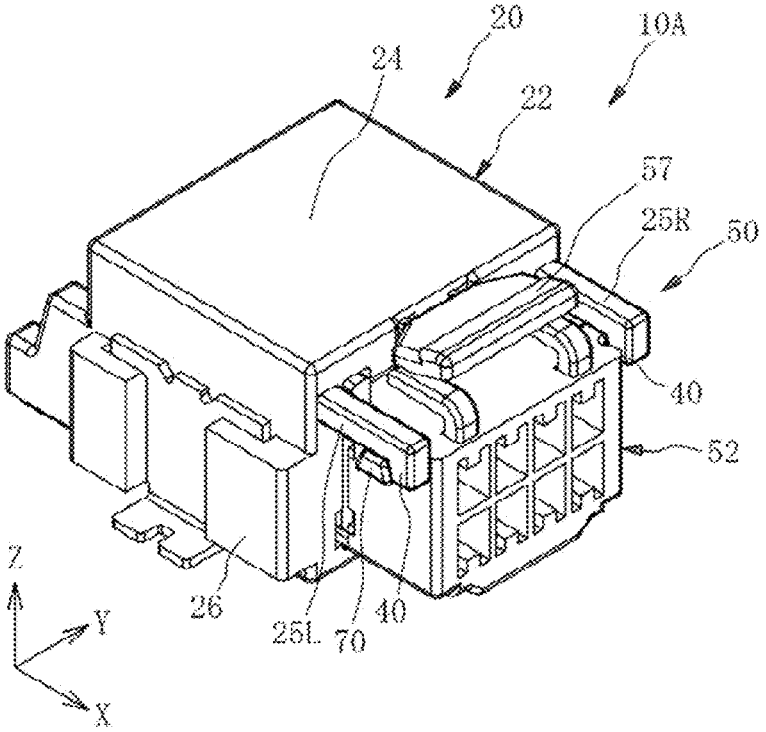
FIG. 22A is a perspective view illustrating a connector apparatus according to a first modified example.
Figure 22B:
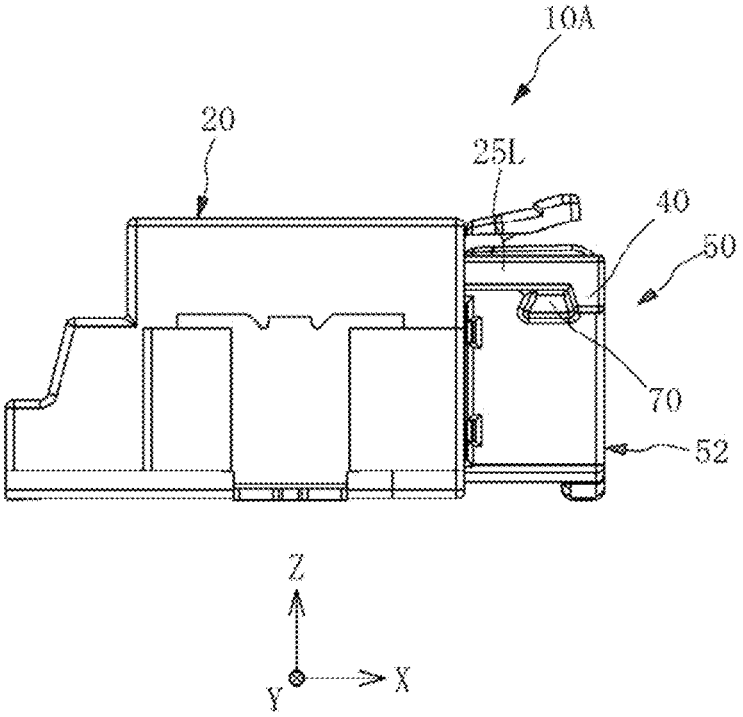
FIG. 22B is a side view of the connector apparatus according to the first modified example.

For example, in the above embodiment, the arms 25R, 25L are formed so as to deflect in the direction spreading from each other. However, the present disclosure is not limited to this structure. For example, like a connector apparatus 10A illustrated in FIGS. 22A, 22B, the arms 25R, 25L may be formed so as to deflect in the same direction. An explanation will be given of the connector apparatus 10A according to a first modified example that employs a different structure for the arms 25R, 25L with reference to FIGS. 22A, 22B.

The connector apparatus 10A includes the first connector 20 and the second connector 50 to be engaged with the first connector 20.

The first connector 20 includes eight male terminals each formed of a conductive material, and the outer housing 22 formed of a plastic material. The outer housing 22 is formed with the pair of arms 25R, 25L and the two second latching parts 40 provided at the respective leading ends of the arms 25R, 25L.

The arms 25R, 25L are each a bar member protruding in the +X direction from an end surface near a corner defined by the celling wall 24 and the side wall 26 that are parts of the wall forming the outer housing 22. The arms 25R, 25L are formed so as to be exposed to the exterior in an engaged condition, enabling the user who attempts to engage the first connector 20 with the second connector 50 to visually check from the exterior. The arms 25R, 25L are provided so as to be deflected upwardly in accordance with an advancement of the engagement between the first connector 20 and the second connector 50.

The second latching parts 40 are formed on the respective lower surfaces (−Z side) of the arms 25R, 25L.

The second connector 50 includes eight female terminals, and the inner housing 52 formed of a resin. The inner housing 52 is formed with the two second latched parts 70.

The second latched parts 70 are to be engaged with the respective second latching parts 40 in accordance with an advancement of the engagement between the first connector 20 and the second connector 50. The second latched parts 70 are formed on both side surfaces (the side surface at the −Y side and the side surface at the +Y side, respectively) of the inner housing 52.

As explained above, according to the connector apparatus 10A in the first modified example, the same effects as those of the connector apparatus 10 in the above embodiment are accomplishable. In view of the easiness of the visual check by the user, however, the arms 25R, 25L according to the embodiment of the present disclosure are desirable.

In addition, according to the embodiment of the present disclosure, the first connector 20 includes the two arms 25R, 25L. However, the present disclosure is not limited to this structure, and the first connector 20 may include one or equal to or greater than three arms. In view of the stable engagement between the first connector 20 and the second connector 50, however, the number of provided arms is desirably two like the arms 25R, 25L according to the embodiment of the present disclosure.

Figure 23:
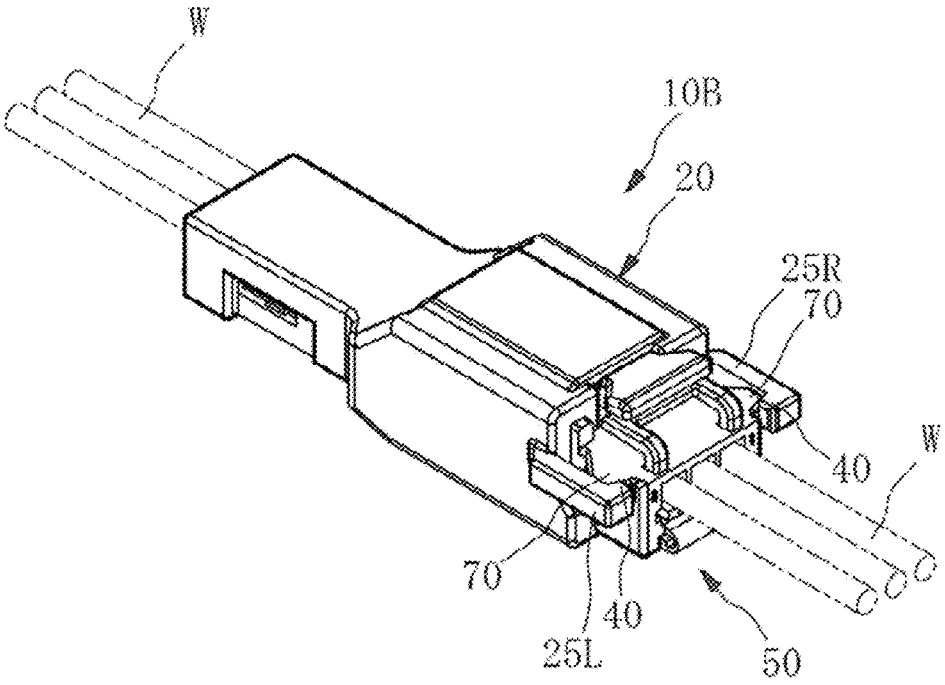
FIG. 23 is a perspective view illustrating a connector apparatus according to a second modified example.

Still further, according to the embodiment of the present disclosure, the first connector 20 is a receptacle connector to be mounted on the wiring board S, while the second connector 50 is a plug connector connected with the wirings W. However, the present disclosure is not limited to this type, and may be a connector apparatus 10B according to a second modified example and illustrated in FIG. 23 which includes both connectors provided with terminals, and the wirings W may be connected to those terminals.

Yet still further, according to the embodiment of the present disclosure, while the second connector 50 is being fitted in the engagement hole 23 of the first connector 20, the timing at which the first latching part 30 reaches the parallel surface 62 and the timing at which the second latching parts 40 reach the respective parallel surfaces 72 are consistent. However, those timings are not necessary to be completely consistent. Those timings may be substantially consistent.

Moreover, according to the embodiment of the present disclosure, while the second connector 50 is being fitted in the engagement hole 23 of the first connector 20, the timing at which the first latching part 30 reaches the first latched part 60 and the timing at which the second latching parts 40 reach the respective second latched parts 70 are consistent. However, those timings are not necessary to be completely consistent. Those timings may be substantially consistent.

Furthermore, according to the embodiment of the present disclosure, the first connector 20 that is a receptacle connector is formed with the first latching part 30 and the second latching parts 40, while the second connector 50 that is a plug connector is formed with the first latched part 60 and the second latched parts 70. However, the present disclosure is not limited to this structure, and the first connector 20 may be formed with a latched part, while the second connector 50 may be formed with a latching part.

In addition, according to the embodiment of the present disclosure, the arms 25R, 25L are formed integrally with the body of the outer housing 22. However, the present disclosure is not limited to this structure, and a structure including at least flexible arms 25R, 25L is adoptive. Likewise, the arm 55 is formed integrally with the inner housing 52, but the present disclosure is not limited to this structure, and a structure including at least a flexible arm 55 is adoptive.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector apparatus comprising:

a first connector that comprises a first latching part, a second latching part, and an arm supporting the second latching part, the arm being formed so as to be exposed to an exterior in an engaged condition to be visible from the exterior; and a second connector that comprises a first latched part to be latched with the first latching part, and a second latched part to be latched with the second latching part, the second connector being to be engaged with the first connector, wherein, in accordance with an advancement of an engagement between the first connector and the second connector, as the first latched part is latched by the first latching part, the second latching part is guided by the second latched part and the arm is deflected, and then, after a latching between the first latching part and the first latched part, as the second latched part is latched by the second latching part, a deflection of the arm is canceled, so that the engagement between the first connector and the second connector is completed, and wherein the arm comprises a pair of bar members protruding from a body of the first connector, and the second latching part is provided at each leading end of the bar members.

2. The connector apparatus according to claim 1, wherein:

the first latched part comprises, from a leading-end side thereof in a fitting direction of the second connector into the first connector in sequence, a first inclined surface that guides the first latching part, and is inclined relative to the fitting direction, and a first parallel surface that is in parallel with the fitting direction;

the second latched part comprises, from a leading-end side thereof in the fitting direction in sequence, a second inclined surface that guides the second latching part, and is inclined relative to the fitting direction, and a second parallel surface that is in parallel with the fitting direction; and when the first latching part reaches the first parallel surface, the second latching part also reaches the second parallel surface.

3. The connector apparatus according to claim 2, wherein:

the second latched part comprises a standing-upright surface provided at a rear end of the second parallel surface in the fitting direction; and the standing-upright surface comprises an inclined surface inclined relative to the fitting direction.

4. The connector apparatus according to claim 1, wherein the pair of bar members is formed so as to deflect in a direction spreading from each other after the first latched part is latched by the first latching part and until the second latched part is latched by the second latching part.

5. The connector apparatus according to claim 1, wherein when the engagement between the first connector and the second connector completes, a position of a rear end of the second connector in a fitting direction, and a position of a leading end of the arm protruding from a body of the first connector are on a same plane orthogonal to the fitting direction of the second connector.

6. The connector apparatus according to claim 1, wherein:

the first connector is a receptacle connector provided on a wiring board; and the second connector is a plug connector that comprises a terminal to which a wiring is connected.

7. The connector apparatus according to claim 1, wherein the first and second connectors are each a connector that comprises a terminal to which a wiring is connected.

* * * * *